US011168280B2

(12) United States Patent
Clarke et al.

(10) Patent No.: US 11,168,280 B2
(45) Date of Patent: Nov. 9, 2021

(54) ADDITIVE CONCENTRATES FOR THE FORMULATION OF LUBRICATING OIL COMPOSITIONS

(71) Applicant: Infineum International Limited, Abingdon (GB)

(72) Inventors: Dean B. Clarke, Neshanic Station, NJ (US); Sonia Oberoi, Edison, NJ (US); Jacob Emert, Brooklyn, NY (US); Anne Young, Brooklyn, NY (US)

(73) Assignee: INFINEUM INTERNATIONAL LIMITED

( * ) Notice: Subject to any disclaimer, the term of this patent is extended or adjusted under 35 U.S.C. 154(b) by 0 days.

(21) Appl. No.: 14/874,688

(22) Filed: Oct. 5, 2015

(65) Prior Publication Data

US 2017/0096617 A1 Apr. 6, 2017

(51) Int. Cl.

| | |
|---|---|
| ***C10M 161/00*** | (2006.01) |
| ***C10M 141/06*** | (2006.01) |
| ***C10M 169/04*** | (2006.01) |
| *C10N 10/04* | (2006.01) |
| *C10N 30/04* | (2006.01) |
| *C10N 30/06* | (2006.01) |
| *C10N 30/00* | (2006.01) |
| *C10N 40/25* | (2006.01) |
| *C10N 70/00* | (2006.01) |

(52) U.S. Cl.

CPC ..... *C10M 161/00* (2013.01); *C10M 141/06* (2013.01); *C10M 169/045* (2013.01); *C10M 2207/028* (2013.01); *C10M 2207/262* (2013.01); *C10M 2215/042* (2013.01); *C10M 2215/08* (2013.01); *C10M 2215/28* (2013.01); *C10M 2219/089* (2013.01); *C10N 2010/04* (2013.01); *C10N 2030/04* (2013.01); *C10N 2030/06* (2013.01); *C10N 2030/52* (2020.05); *C10N 2030/54* (2020.05); *C10N 2040/25* (2013.01); *C10N 2040/252* (2020.05); *C10N 2070/02* (2020.05)

(58) Field of Classification Search

CPC ..... C10M 161/00; C10M 141/06; C10M 169/045; C10M 2219/046; C10N 2070/02; C10N 2030/08

USPC ..... 508/287–295

See application file for complete search history.

(56) References Cited

U.S. PATENT DOCUMENTS

| | | | |
|---|---|---|---|
| 3,087,936 | A | 4/1963 | Le Suer |
| 3,254,025 | A | 5/1966 | Le Suer |
| 4,152,499 | A | 5/1979 | Boerzel et al. |
| 4,867,890 | A | 9/1989 | Colclough et al. |
| 4,927,551 | A | 5/1990 | Erdman et al. |
| 4,938,881 | A | 7/1990 | Ripple et al. |
| 5,230,714 | A | 7/1993 | Steckel |
| 5,241,003 | A | 8/1993 | Degonia et al. |
| 5,451,333 | A | 9/1995 | Waddoups et al. |
| 5,565,128 | A | 10/1996 | Gutierrez |
| 5,616,816 | A | 4/1997 | Burjes et al. |
| 5,714,443 | A | 2/1998 | Cane et al. |
| 5,716,914 | A | 2/1998 | Cane et al. |
| 5,756,431 | A | 5/1998 | Emert et al. |
| 5,792,730 | A | 8/1998 | Gutierrez et al. |
| 5,808,145 | A | 9/1998 | Le Coent et al. |
| 5,854,186 | A | 12/1998 | Cusumano et al. |
| 6,001,785 | A | 12/1999 | Le Coent et al. |

(Continued)

FOREIGN PATENT DOCUMENTS

| | | |
|---|---|---|
| EP | 0271363 A2 | 6/1988 |
| EP | 0323088 A1 | 7/1989 |

(Continued)

OTHER PUBLICATIONS

American Petroleum Institute, Engine Oil Licensing and Certification System, Industry Services Dept., API 1509, 14th Edition, Dec. 1996, Addendum 1, Dec. 1998.

(Continued)

*Primary Examiner* — Ellen M McAvoy

(57) ABSTRACT

A lubricant additive concentrate containing (i) dispersant that is the polybutenyl succinimide reaction product of a polyamine and polybutenyl succinic anhydride (PIBSA) derived from polybutene having a number average molecular weight ($M_n$) of from about 1300 to about 2500 daltons and a terminal vinylidene content of at least about 50% and maleic anhydride via an ene maleation process; (ii) overbased magnesium colloidal detergent having a total base number (TBN) of from about 300 to about 900 mg KOH/g; and (iii) organic friction modifier selected from hydroxyalkyl alkyl amines of $C_{14}$ to $C_{24}$ hydrocarbons, at least one hydroxyalkyl alkyl ether amines of $C_{13}$ to $C_{24}$ hydrocarbons, at least one alkyl ester amine derived from triethanol amine having a $C_{13}$ to $C_{24}$ hydrocarbyl substituent, at least one non-basic, fatty acid amide, or a mixture thereof; wherein the combined mass % of dispersant (i) and overbased magnesium colloidal detergent (ii) in said concentrate is from about 15 to about 50 mass %: the mass ratio of (i):(ii) is from about 1:1 to about 6:1; and the concentrate contains from about 2 to about 10 mass % of organic friction modifier (iii); the remainder of the concentrate being composed of base oil and additives other than dispersant (i), overbased magnesium colloidal detergent (ii) and organic friction modifier (iii).

19 Claims, No Drawings

(56) References Cited

U.S. PATENT DOCUMENTS 6,090,759 A 7/2000 Cane et al.
6,153,565 A 11/2000 Skinner et al.
6,200,936 B1 3/2001 Moreton
6,281,179 B1 8/2001 Skinner et al.
6,429,178 B1 8/2002 Skinner et al.
6,429,179 B1 8/2002 Skinner et al.
6,625,351 B2 9/2003 Cox et al.
6,734,148 B2 5/2004 Bell et al.
6,743,757 B2 6/2004 Bell et al.
7,339,007 B2 * 3/2008 Irving ..... C08F 8/14 525/333.7
7,462,583 B2 12/2008 Wilk et al.
7,786,060 B2 * 8/2010 Fellows ..... C10M 163/00 508/455
8,163,681 B2 * 4/2012 Bardasz ..... C10M 169/045 508/110
8,513,169 B2 * 8/2013 Diggs ..... C10M 163/00 508/110
8,709,988 B2 * 4/2014 Arrowsmith ..... C10M 163/00 508/165
9,249,371 B2 * 2/2016 Loper ..... C10M 133/44
9,347,019 B2 * 5/2016 Shaw ..... C10M 169/04
10,472,584 B2 * 11/2019 Emert ..... C10M 163/00
10,487,288 B2 * 11/2019 Skinner ..... C10M 141/06
10,781,392 B2 * 9/2020 Woodward ..... C10M 129/74
2005/0202981 A1 9/2005 Eveland et al.
2006/0105925 A1 * 5/2006 Fellows ..... C10M 163/00 508/585
2007/0027057 A1 2/2007 Le Coent et al.
2007/0049504 A1 * 3/2007 Culley ..... C10L 1/143 508/233
2008/0146473 A1 * 6/2008 Van Leeuwen ..... C10M 163/00 508/287
2010/0069273 A1 * 3/2010 Skinner ..... C10M 159/22 508/278
2010/0081594 A1 4/2010 Walker
2010/0081727 A1 * 4/2010 Hanefeld ..... C08F 8/46 522/120
2011/0136711 A1 * 6/2011 Wang ..... C10M 159/24 508/391
2012/0283158 A1 * 11/2012 Mullay ..... C10M 163/00 508/186
2012/0329691 A1 * 12/2012 Delbridge ..... C10M 169/04 508/391
2014/0045734 A1 2/2014 Burrington et al.
2014/0179570 A1 * 6/2014 Loper ..... C10M 133/16 508/186
2014/0179572 A1 6/2014 Loper et al.
2015/0024983 A1 * 1/2015 Walker ..... C10M 159/24 508/192
2015/0045268 A1 * 2/2015 Davies ..... C10M 163/00 508/306
2015/0240181 A1 * 8/2015 Ayutsede ..... C10M 141/08 508/460
2017/0029738 A1 * 2/2017 Emert ..... C10M 169/06
2017/0073607 A1 * 3/2017 Skinner ..... C10M 163/00

FOREIGN PATENT DOCUMENTS

EP 0330523 A2 8/1989
EP 0355895 B1 12/1994
EP 2746374 A2 6/2014
EP 3153568 A1 4/2017
WO WO-99/52999 A1 10/1999
WO 2010081594 A1 7/2010
WO WO-2011/066142 A1 6/2011

OTHER PUBLICATIONS

W.W. Yau, J.J. Kirkland, D.D. Bly, Modern Size Exclusion Liquid Chromatography, John Wiley & Sons, New York 1979.

* cited by examiner

ADDITIVE CONCENTRATES FOR THE FORMULATION OF LUBRICATING OIL COMPOSITIONS

The present invention relates to storage stable additive concentrates for the formulation of lubricating oil compositions, which additive concentrates contain dispersants thermally derived from highly reactive polybutene, together with overbased magnesium colloidal detergent and organic friction modifier.

BACKGROUND OF THE INVENTION

Crankcase lubricants for passenger car and heavy duty diesel engines contain numerous additives providing the lubricant with an array of performance properties required for optimum function and protection of the respective engines. Each individual additive needs to provide the performance benefit for which it was designed without interfering with the function of the other additives in the lubricant. Within each additive class (e.g. dispersant or detergent) a number of options are available that differ in structure, such as molecular weight, metal type, hydrophobic/hydrophilic balance, etc. The selection of the additives for any given formulation must take into account both the relative performance characteristics of the individual additives, as well as synergies or antagonisms with other additives present in the oil.

Additive packages containing multiple additives are typically sold to lubricant formulators in the form of concentrates, to enable the introduction of a range of base stocks to target different viscosity grades, performance levels and costs. This leads to further complications in that the selected additives must be compatible with each other in the concentrate to avoid additive package instability and phase separation. This issue has been exacerbated by the drive to increase the fuel economy performance of engine lubricants, which has led to the use of higher concentrations of organic friction modifiers to reduce internal friction within the engine. Organic friction modifiers are typically highly surface active and interact strongly with other polar additives in the concentrate. Specifically, the combination of certain polymeric dispersants, and/or specific overbased colloidal detergents with large amounts of organic friction modifier can lead to phase separation in additive concentrates after long term storage, particularly at elevated temperatures. Although all of these additives are required to control sludge and deposits, maintain the basicity of the lubricant and reduce friction, the use of such additives in combination, in concentrates, raises difficult challenges due to the high level of interaction between the individual additives.

In some cases, the most desirable additive structure from a performance standpoint interacts more strongly in the concentrate compared to other alternatives. For example, it has been unexpectedly found that high molecular weight dispersants derived from polymers having a narrow molecular weight distribution that are functionalized via a thermal "ene" reaction and derivatized with a polyamine, are more sensitive to phase separation in concentrates also containing colloidal detergents and high concentrations of organic friction modifier, compared to corresponding dispersants derived from polymers with broader molecular weight distributions that are functionalized via a chlorine-assisted process. The use of the former class of dispersant however, is particularly favored in some applications to eliminate residual chlorine and provide optimum piston deposit control, as described, for example, in U.S. Pat. Nos. 6,743,757 and 6,734,148. Similarly, a particularly favored organic friction modifier, glycerol monooleate (GMO) is particularly prone to induce phase separation in additive concentrates containing high molecular weight dispersants and/or overbased colloidal detergents, even when present at a concentration that is lower than that required to provide effective friction reduction. This limits the use of GMO as a fuel economy additive for modern engines.

U.S. Pat. No. 7,786,060 illustrates the problems associated with the formation of stable additive concentrates containing overbased calcium sulfonate detergents and high concentrations of organic friction modifiers such as glycerol monooleate and or ethoxylated tallow amine (ETA). As shown in the patent, concentrates containing only 1.1 mass % and 1.7 mass % of the above friction modifiers, respectively (2.8 mass % total), failed the long term stability test at elevated temperatures. Adequate stability of concentrates containing 3.4 mass % of these friction modifiers for the entire duration of the test could only be achieved by adding 5.6 to 11.1 mass % of a hydrocarbyl phenol aldehyde concentrate. US Pre-Grant Publications 2014/0179570; 2014/0179572 and EP 2746374 describe engine oil compositions comprising a combination of additives including an amido-ester, amido-amide or amido-carboxylate friction modifier of a defined structure. US Pre-Grant Publication 2014/0045734 describes the stabilization of functional fluid compositions containing a poorly soluble phosphorus-based friction modifier. A high temperature pre-blending process for producing haze resistant compositions containing succinimide dispersants and overbased detergents is described in U.S. Pat. No. 5,451,333, which also allows for the presence of other additives including a range of ester, amide, metal, phosphorus or sulfur-containing friction modifiers.

There remains a need for additive concentrates that can deliver the required high level of polymeric dispersant, colloidal detergent and friction modifier required to formulate modern crankcase lubricants, which additive concentrates remain stable even after extended storage periods at elevated temperatures, preferably without the need to add high levels of compatibility aids that do not themselves provide some performance enhancing property to the fully formulated lubricating oil composition.

The present invention is directed to additive concentrates containing (i) a succinimide dispersant derived from high molecular weight polyisobutylene having a terminal vinylidene content of greater than 50%, functionalized with maleic anhydride via a thermal "ene" reaction, and derivatized with polyamine; (ii) overbased magnesium colloidal detergent; and organic friction modifier comprising friction modifier (iii) selected from at least one hydroxyalkyl alkyl amine, at least one hydroxyalkyl alkyl ether amine, at least one alkyl ester amine derived from triethanol amine, at least one non-basic, fatty acid amide, or a mixture thereof, in specified concentration ranges and ratios. Surprisingly, such additive concentrates have been found to maintain long term stability, even when stored at elevated temperatures, while providing amounts of additive sufficient to achieve excellent sludge and deposit control and low friction properties in crankcase lubricants formulated with same.

SUMMARY OF THE INVENTION

In accordance with a first aspect of the invention, there is provided a lubricant additive concentrate comprising (i) dispersant that is the polybutenyl succinimide reaction product of a polyamine and polybutenyl succinic anhydride (PIBSA) derived from polybutene having a number average molecular weight ($M_n$) of from about 1300 to about 2500 daltons and a terminal vinylidene content of at least about 50% and maleic anhydride via a thermal or "ene" maleation process; (ii) overbased magnesium colloidal detergent having a TBN of from about 300 to about 900 mg KOH/g (on an A.I. basis); and organic friction modifier comprising organic friction modifier (iii) selected from at least one hydroxyalkyl alkyl amine, at least one hydroxyalkyl alkyl ether amine, at least one alkyl ester amine derived from triethanol amine, at least one non-basic, fatty acid amide, or a mixture thereof; wherein the combined mass % of dispersant (i) and overbased magnesium colloidal detergent (ii) in the concentrate is from about 15 to about 40 mass % (on an A.I. basis); the mass ratio of (i):(ii) is from about 1:1 to about 6:1; and the concentrate contains from about 2 to about 10 mass % of organic friction modifier (iii); the remainder of the concentrate comprising base oil and additives other than (i), (ii) and (iii).

In accordance with a second aspect of the invention, there is provided a lubricant additive concentrate, as in the first aspect, wherein the dispersant (i) has a functionality of from about 1.3 to about 2.2 and/or is derived from polybutene having a molecular weight distribution (MWD; $M_w/M_n$) of from about 1.2 to about 3.0.

In accordance with a third aspect of the invention, there is provided a lubricant additive concentrate, as in the first or second aspect, wherein overbased magnesium colloidal detergent (ii) is, or includes hybrid detergent derived from two or more different surfactants.

In accordance with a fourth aspect of the invention, there is provided a lubricant additive concentrate, as in the first, second or third aspect, wherein the concentrate comprises a mixture of magnesium and calcium and/or sodium detergents.

In accordance with a fifth aspect of the invention, there is provided a lubricant additive concentrate, as in the first, second, third or fourth aspect, wherein the concentrate comprises a mixture of organic friction modifier (iii) and organic friction modifier other than (iii).

In accordance with a sixth aspect of the invention, there is provided a lubricant additive concentrate, as in the first, second, third, fourth or fifth aspect, wherein the total concentration of organic friction in the concentrate is from about 4 mass % to about 10 mass %.

In accordance with a seventh aspect of the invention, there is provided a lubricant additive concentrate, as in the first, second, third, fourth, fifth or sixth aspect, wherein the concentrate further contains a low molecular weight hydrocarbyl or hydrocarbenyl succinic anhydride or succinimide compatibility aid, derived from a hydrocarbyl or hydrocarbenyl group having a number average molecular weight ($M_n$) of from about 150 to about 1200 daltons, such as octadecenyl succinic anhydride (ODSA) or polyisobutenyl succinic anhydride (PIBSA), preferably in an amount of from about 0.2 mass % to about 8 mass %.

Other and further objects, advantages and features of the present invention will be understood by reference to the following specification.

DETAILED DESCRIPTION OF THE INVENTION

Dispersants useful in the context of the present invention are polybutenyl succinimide dispersants that are the reaction product of a polyamine and polybutenyl succinic anhydride (PIBSA) derived from polybutene having a number average molecular weight ($M_n$) of greater than about 1300, 1500, and preferably greater than 1800, and less than about 2500 such as less than about 2400. The polybutenyl succinic anhydride (PIBSA) is derived from polybutene having a terminal vinylidene content of at least about 50%, 60%, 70%, preferably at least about 80%, and succinic and/or maleic anhydride via an "ene" or thermal maleation process.

The dispersants of the present invention preferably have a functionality of from about 1.3 to about 2.2, such as a functionality of from about 1.4 to about 2.0, more preferably from about 1.5 to about 1.9. Functionality (F) can be determined according to the following formula:

$$F=(SAP\times M_n)/((1122\times A.I.)-(SAP\times MW)) \quad (1)$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer (polybutene); A.I. is the percent active ingredient of the succinic-containing reaction product (the remainder being unreacted polybutene and diluent); and MW is the molecular weight of the dicarboxylic acid-producing moiety (98 for maleic anhydride). Generally, each dicarboxylic acid-producing moiety (succinic group) will react with a nucleophilic group (polyamine moiety) and the number of succinic groups in the PIBSA will determine the number of nucleophilic groups in the finished dispersant.

Polymer molecular weight, specifically $M_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

Suitable hydrocarbons or polymers employed in the formation of the dispersants of the present invention include polymers prepared by cationic polymerization of isobutene. Common polymers from this class include polyisobutenes obtained by polymerization of a $C_4$ refinery stream having a butene content of about 35 to about 75% by wt., and an isobutene content of about 30 to about 60% by wt., in the presence of a Lewis acid catalyst, such boron trifluoride ($BF_3$). Preferably, the polyisobutylene is prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 60%, e.g., 70%, more preferably at least 80%, most preferably, at least 85%. The preparation of such polymers is described, for example, in U.S. Pat. No. 4,152,499. Such polymers are conventionally referred to as HR-PIB and HR-PIB is commercially available from Texas Petrochemical Corporation (TPC), or from BASF (under the trade names Glissopal™). Processes for thermally reacting HR-PIB with unsaturated carboxylic acids or anhydrides, and for further reacting the resulting acylating agents (PIBSA) with amines are well known and described, for example, in U.S. Pat. No. 4,152,499 and EP 0 355 895. Preferably, the HR-PIB used to produce the dispersant of the present invention will have a narrow molecular weight distribution (MWD), also referred to as polydispersity as determined by the ratio of weight average molecular weight ($M_w$) to number average molecular weight ($M_n$). Specifically, the HR-PIB from which the dispersants of the present invention are derived have a $M_w/M_n$ of about 1.2 to about 3.0, such as from about 1.5 to about 2.5 or from about 1.6 to about 2.3, more preferably from about 1.7 to about 2.2.

To provide the required functionality, the monounsaturated carboxylic reactant, (maleic anhydride), typically will be used in an amount ranging from about 5 to about 300% excess, preferably from about 10 to 200%, such as 20 to 100% excess, based on the moles of polymer. Unreacted excess monounsaturated carboxylic reactant can be removed from the final dispersant product by, for example, stripping, under vacuum, if required.

Polyamines useful in the formation of the dispersants of the present invention include polyamines having, or having on average, 3 to 8 nitrogen atoms per molecule, preferably from about 5 to about 8 nitrogen atoms per molecule. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Mixtures of amine compounds may advantageously be used, such as those prepared by reaction of alkylene dihalide with ammonia. Preferred amines are aliphatic saturated amines, including, for example, polyethylene amines such as diethylene triamine; triethylene tetramine; tetraethylene pentamine; and polypropyleneamines such as di-(1,2-propylene) triamine. Such polyamine mixtures, known as PAM, are commercially available. Useful polyamine mixtures also include mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Preferably, the dispersants of the present invention have a coupling ratio of from about 0.7 to about 1.3, preferably from about 0.8 to about 1.2, most preferably from about 0.9 to about 1.1. In the context of this disclosure, "coupling ratio" may be defined as a ratio of succinyl groups in the PIBSA to primary amine groups in the polyamine reactant.

Lubricant additive concentrates of the present invention may contain polymeric dispersant additives other than the high molecular weight, high functionality dispersant of the present invention, however, the dispersant of the present invention preferably constitutes at least 61 mass %, such as at least 70 mass %, more preferably at least 80 mass %, such as at least 85 or 90 or 95 mass % of the total mass of dispersant in the concentrate. Such "other polymeric dispersant additives" can include polybutenyl succinimide reaction products of a polyamine and polybutenyl succinic anhydride (PIBSA), which is derived from polybutene having a number average molecular weight ($M_e$) of less than 1300 and a terminal vinylidene content of at least 50%, and maleic anhydride via an ene maleation process, as well as succinimide dispersants prepared using a halogen (e.g., chlorine) assisted alkylation process. The "other polymeric dispersant additives" may also include dispersants derived from polymers other than polybutene, such as polypropylene polymers, ethylene-propylene copolymers, ethylene-butene copolymers and copolymers of butene and maleic anhydride.

Either or each of the high molecular weight, high functionality dispersant of the present invention and the "other polymeric dispersant additives" may be post treated by a variety of conventional post treatments such as boration, as generally taught in U.S. Pat. Nos. 3,087,936 and 3,254,025. Boration of the dispersant is readily accomplished by treating an acyl nitrogen-containing dispersant with a boron compound such as boron oxide, boron acids, and esters of boron acids, in an amount sufficient to provide from about 0.1 to about 20 atomic proportions of boron for each mole of acylated nitrogen composition. Useful dispersants contain from about 0.05 to about 2.5 mass %, e.g., from about 0.05 to about 1.5 mass % boron. The boron, which appears in the product as dehydrated boric acid polymers (primarily $(HBO_2)_3$), is believed to attach to the dispersant imides and diimides as amine salts, e.g., the metaborate salt of the diimide. Boration can be carried out by adding from about 0.5 to 4 mass %, e.g., from about 1 to about 3 mass % (based on the mass of acyl nitrogen compound) of a boron compound, preferably boric acid, usually as a slurry, to the acyl nitrogen compound and heating with stirring at from about 135° C. to about 190° C., e.g., 140° C. to 170° C., for from about 1 to about 5 hours, followed by nitrogen stripping. Alternatively, the boron treatment can be conducted by adding boric acid to a hot reaction mixture of the dicarboxylic acid material and amine, while removing water. Other post reaction processes commonly known in the art can also be applied. Preferably, the high molecular weight, high functionality dispersant of the present invention is not borated. Other post treatment agents include ethylene carbonate, aliphatic aromatic acids and phenolics.

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80 mg KOH/g (on an A.I. basis) or from 0 to 150 mg KOH/g (on an non-A.I. basis, diluted in oil). A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. hydroxide or carbonate) micelle. Such overbased detergents may have a TBN of 300 mg KOH/g or greater (on an A.I. basis), and typically will have a TBN of from 400 to 1000 mg KOH/g or more (on an A.I. basis).

The additive concentrates of the present invention contain one or more overbased magnesium colloidal detergent(s) having a total base number (TBN) of from about 300 to about 900 mg KOH/g (on an A.I. basis). These overbased magnesium colloidal detergent(s) may be derived from one or more surfactants selected from (a) sulfonate; (b) phenate; and (c) hydroxybenzoate (e.g., salicylate) surfactants.

Sulfonate detergents can be aliphatic or aromatic. Aromatic sulfonate detergents may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble alkyl sulfonates or alkaryl sulfonic acids may be neutralized with oxides, hydroxides, alkoxides, carbonates, carboxylate, sulfides, hydrosulfides, nitrates, borates and ethers of a metal. The amount of metal compound is chosen having regard to the desired TBN of the final product but typically ranges from about 100 to 220 mass % (preferably at least 125 mass %) of that stoichiometrically required.

Phenate detergents, metal salts of phenols and sulfurized phenols, are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges. The term "phenate", as used herein with reference to surfactant type, is also intended to include alkyl-bridged phenol condensates, as described, for example, in U.S. Pat. No. 5,616,816; bridged or unbridged phenol condensates substituted with —CHO or $CH_2OH$ groups, sometimes referred to as "saligenin", as described, for example, in U.S. Pat. No. 7,462,583 as well as phenates that have been modified by carboxylic acids, such as stearic acid, as described, for example, in U.S. Pat. Nos. 5,714,443; 5,716,914; 6,090,759.

Hydroxybenzoate detergents, e.g., salicylates, can be prepared from hydrocarbyl-substituted hydroxybenzoic acids. Hydroxybenzoic acids are typically prepared by the carboxylation, by the Kolbe-Schmitt process, of phenoxides, and in that case, will generally be obtained (normally in a diluent) in admixture with uncarboxylated phenol. Hydroxybenzoic acids may be non-sulfurized or sulfurized, and may be chemically modified and/or contain additional substituents. Processes for sulfurizing a hydrocarbyl-substituted hydroxybenzoic acid are well known to those skilled in the art, and are described, for example, in US 2007/0027057.

In hydrocarbyl-substituted hydroxybenzoic acids, the hydrocarbyl group is preferably alkyl (including straight- or branched-chain alkyl groups), and the alkyl groups advantageously contain 5 to 100, preferably 9 to 30, especially 14 to 24, carbon atoms. Preferably, the hydrocarbyl-substituted hydroxybenzoate surfactant is hydrocarbyl-substituted salicylate surfactant derived from hydrocarbyl substituted salicylic acid. As with hydrocarbyl-substituted hydroxybenzoic acids generally, the preferred substituents in oil-soluble salicylic acids are alkyl substituents, and in alkyl-substituted salicylic acids, the alkyl groups advantageously contain 5 to 100, preferably 9 to 30, especially 14 to 24, carbon atoms. Where there is more than one alkyl group, the average number of carbon atoms in all of the alkyl groups is preferably at least 9 to ensure adequate oil solubility.

The hydrocarbyl-substituted hydroxybenzoic acid may be neutralized with oxides, hydroxides, alkoxides, carbonates, carboxylate, sulfides, hydrosulfides, nitrates, borates and ethers of a metal. The amount of metal compound is chosen having regard to the desired TBN of the final product but typically ranges from about 100 to 220 mass % (preferably at least 125 mass %) of that stoichiometrically required.

The term "hydroxybenzoate", as used herein with reference to surfactant type, is intended to include salicylates, as well as so-called "phenalates", as described, for example, in U.S. Pat. Nos. 5,808,145; and 6,001,785, and optionally substituted bridged phenol/salicylate condensates, sometimes referred to as "salixarates", which are described, for example, in U.S. Pat. No. 6,200,936.

The overbased magnesium colloidal detergent of the present invention may also be a "hybrid" detergent formed with mixed surfactant systems, e.g., phenate/salicylates, sulfonate/phenates, sulfonate/salicylates, and sulfonates/phenates/salicylates, as described, for example, in U.S. Pat. Nos. 6,153,565; 6,281,179; 6,429,178; and 6,429,179.

Lubricant additive concentrates of the present invention may also contain neutral magnesium detergents as well as neutral and overbased detergents based on metals other than magnesium, such as calcium and/or sodium. However, overbased magnesium colloidal detergent(s) of the present invention preferably constitute at least 15 mass %, such as at least 20 mass %, at least 30 mass % or at least 40 mass %, preferably at least 50 mass %, such as at least 60, 70 or 80 mass % of the total mass of detergent in the concentrate.

The organic friction modifiers of the present invention comprise organic friction modifier (iii) selected from at least one hydroxyalkyl alkyl amines of $C_{14}$ to $C_{24}$ hydrocarbons (e.g., bis-(2-hydroxyethyl) tallow amine, at least one hydroxyalkyl alkyl ether amines of $C_{13}$ to $C_{24}$ hydrocarbons (e.g., bis-(2-hydroxyethyl) octadecyloxypropyl amine), at least one alkyl ester amine derived from triethanol amine having a $C_{13}$ to $C_{24}$ hydrocarbyl substituent (e.g., tri, di and mono-tallow esters of triethanolamine), at least one non-basic, fatty acid amide (e.g., oleamide), or a mixture thereof. In addition to the above organic friction modifier (iii), the lubricant additive concentrates of the present invention may also contain other organic friction modifiers or fuel economy agents. Examples of such materials include glyceryl monoesters of higher fatty acids, for example, glyceryl mono-oleate; alkylated tartaric acid derivatives; esters of long chain polycarboxylic acids with diols, for example, the butane diol ester of a dimerized unsaturated fatty acid; and oxazoline compounds.

The lubricant additive concentrates of the present invention may optionally further contain a low molecular weight hydrocarbyl or hydrocarbenyl succinimide or succinic anhydride compatibility aid, derived from a hydrocarbyl or hydrocarbenyl group having a number average molecular weight ($M_n$) of from about 150 to about 1200 daltons, such as octadecenyl succinic anhydride (ODSA) or polyisobutenyl succinic anhydride (PIBSA). The PIBSA compatibility aid, or PIBSA from which the low molecular weight succinimide compatibility aid is derived by be formed via either a thermal "ene" reaction, or using a halogen (e.g., chlorine) assisted alkylation process.

Oils of lubricating viscosity that may be used as the diluent in the additive concentrates of the present invention may be selected from natural lubricating oils, synthetic lubricating oils and mixtures thereof. Generally, the viscosity of these oils ranges from about 2 $mm^2$/sec (centistokes) to about 40 $mm^2$/sec, especially from about 4 $mm^2$/sec to about 20 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The diluent oil may comprise a Group I, Group II, Group III, Group IV or Group V base stocks or blends of the aforementioned base stocks. Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998.

The lubricant additive concentrates of the present invention comprise amounts of (i) dispersant that is the polybutenyl succinimide reaction product of a polyamine and polybutenyl succinic anhydride (PIBSA) derived from polybutene having a number average molecular weight ($M_n$) of from about 1300 to about 2500 daltons and a terminal vinylidene content of at least about 50%, and maleic anhydride via a thermal or "ene" maleation process; (ii) overbased magnesium colloidal detergent having a total base number (TB N) of from about 300 to about 900 mg KOH/g (on an A.I. basis); and (iii) organic friction modifier selected from at least one hydroxyalkyl alkyl amines of $C_{14}$ to $C_{24}$ hydrocarbons (e.g., bis-(2-hydroxyethyl) tallow amine, at least one hydroxyalkyl alkyl ether amines of $C_{13}$ to $C_{24}$ hydrocarbons (e.g., bis-(2-hydroxyethyl) octadecyloxypropyl amine), at least one alkyl ester amine derived from triethanol amine having a $C_{13}$ to $C_{24}$ hydrocarbyl substituent (e.g., tri, di and mono-tallow esters of triethanolamine), at least one non-basic, fatty acid amide (e.g., oleamide), or a mixture thereof; such that the combined mass % of dispersant (i) and overbased magnesium colloidal detergent (ii) in the concentrate is from about 15 to about 50 mass % (on an A.I. basis); the mass ratio of (i):(ii) is from about 1:1 to about 6:1, such as from about 1.4:1 to about 5.0:1, preferably from about 1.5:1 to about 4.0:1; and the concentrate contains from about 2 to about 10 mass % of organic friction modifier (iii); with the remainder of the concentrate comprising base oil and additives other than (i), (ii) and (iii). Preferably, the total concentration of organic friction modifier (including organic friction modifier (iii) and any other organic friction modifier) in the lubricant additive concentrates of the present invention is from about 4 mass % to about 10 mass %.

If additional stabilization of the lubricant additive concentrate is required, from about 0.25 mass % to about 8 mass %, such as from about 0.5 mass % to about 7 mass %, from about 0.75 mass % to about 7 mass % or from about 1.0 to about 6 mass %, based on the total mass of the concentrate, of one or more of the above described compatibility aid(s) may be substituted for an equal amount of base oil. It is noted that, if a compatibility aid is to be added to the lubricant additive concentrate of the present invention, it should not be introduced into the concentrate without the detergent being present. If the compatibility aid is introduced together with the dispersant in the absence of the detergent, the efficacy of the compatibility aid may be reduced.

Additional additives may be incorporated into the compositions of the invention to enable particular performance requirements to be met. Examples of additives which may be included in the lubricating oil compositions of the present invention are metal rust inhibitors, corrosion inhibitors, oxidation inhibitors, non-organic friction modifiers, anti-foaming agents, anti-wear agents and pour point depressants. Some are discussed in further detail below.

Dihydrocarbyl dithiophosphate metal salts are frequently used as antiwear and antioxidant agents. The metal may be an alkali or alkaline earth metal, or aluminum, lead, tin, molybdenum, manganese, zinc, nickel or copper. The zinc salts are most commonly used in lubricating oil in amounts of from about 0.1 mass % to about 10 mass %, preferably from about 0.2 mass % to about 2 mass %, based upon the total weight of the lubricating oil composition, and thus, are conventionally present in additive concentrates in amounts of from about 2 mass % to about 20 mass %. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, aromatic amines having at least two aromatic groups attached directly to the nitrogen (e.g., di-phenyl amines), alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in U.S. Pat. No. 4,867,890, and molybdenum-containing compounds.

Non-organic friction modifiers include oil-soluble molybdenum oxide complexes and organo-molybdenum compounds. Such organo-molybdenum friction modifiers also provide antioxidant and antiwear credits to a lubricating oil composition. Oil soluble organo-molybdenum compounds, include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates. Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MooCL_4$, $MoO_2Br_2$, $Mo_2O_3Cl_6$, molybdenum trioxide or similar acidic molybdenum compounds.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

The total additive content of the lubricant additive concentrates of the present invention can be from about 20 mass % to about 70 mass %, such as from about 35 mass % to about 50 mass %, based on the total mass of the concentrate. To insure acceptable handling ability, the lubricant additive concentrates of the present invention preferably have a kinematic viscosity at 100° C. ($kv_{100}$) of less than about 300 cSt, such as less than about 250 cSt or less than about 200 cSt.

This invention will be further understood by reference to the following examples, wherein all parts are parts by weight, unless otherwise noted and which include preferred embodiments of the invention.

EXAMPLES

Long term storage stability of concentrates was assessed as described in the aforementioned U.S. Pat. No. 7,786,060. Specifically, the concentrates were stored for a number of weeks (up to 12 weeks) at a temperature of 60° C. with periodic measuring of the amount of sediment formed. An additive concentrate failed the stability test at the time the amount of sediment measured exceeded 0.05 mass %, based on the total mass of the concentrate. The results of the stability tests are shown in the following Tables 1 to 3.

TABLE 1

| Ex | Disp Type | FV | Disp. + Det. AI (mass %) | Disp:Det Ratio | FM (mass %) | Conc Stab @ 12 wks (vol % sed) |
|---|---|---|---|---|---|---|
| 1 | Ene | 1.4 | 32 | 2.0 | 3.0 | 0.08 |
| 2 | Ene | 1.9 | 32 | 2.0 | 3.0 | 0.10 |
| 3 | Chloro | 1.4 | 32 | 2.0 | 3.0 | tr* |
| 4 | Ene | 1.9 | 29 | 0.8 | 4.7 | 0.30 |
| 5 | Chloro | 1.4 | 29 | 0.8 | 4.7 | tr* |
| 6 | Ene | 1.9 | 25 | 1.7 | 3.9 | 0.05 |
| 7 | Chloro | 1.4 | 25 | 1.7 | 3.9 | tr* |
| 8 | Ene | 1.9 | 36 | 2.2 | 2.4 | 0.15 |
| 9 | Chloro | 1.4 | 36 | 2.2 | 2.4 | tr* |
| 10 | Ene | 1.9 | 34 | 4.3 | 2.8 | 0.02 |
| 11 | Chloro | 1.4 | 34 | 4.3 | 2.8 | tr* |

*trace

Table 1 illustrates the increased challenge associated with the production of stable additive concentrates containing the dispersants (i) of the present invention, relative to analogous dispersants produced from conventional polybutenes, functionalized via the chloro-assisted process. In the above concentrates, both the dispersants (i) of the present invention and the analogous dispersants produced from conventional polybutenes, functionalized via the chloro-assisted process were derived by polybutene (PIB) having an $M_n$ of 2200. The PIB from which the dispersant (i) of the present invention was derived was highly reactive PIB (HR-PIB), having a terminal vinylidene content of about 80% and a molecular weight distribution (MWD) of about 2.0. The PIB from which the non-inventive dispersants were derived was a conventional PIB having a MWD of about 2.3. The detergent used in each of the concentrates was an overbased calcium alkyl sulfonate detergent having a TBN of 600 mg KOH/g on an AI basis. Two dispersant functionality values (FV), and a range of dispersant:detergent ratios were tested, using a triethanol amine ester friction modifier (TEEMA).

TABLE 2

| Ex | Disp Type | FV | Disp + Det AI (mass %) | Disp:Det Ratio | FM Type | FM (mass %) | PIBSA (mass %) | Conc Stab @ 12 wks (vol % sed) |
|---|---|---|---|---|---|---|---|---|
| 12 | Ene | 1.9 | 35 | 3.1 | None | 0.0 | 1.4 | tr* |
| 13 | Ene | 1.9 | 34 | 3.2 | TEEMA | 2.4 | 1.4 | 0.08 |
| 14 | Ene | 1.9 | 35 | 3.2 | GMO | 0.5 | 1.4 | tr* |
| 15 | Ene | 1.9 | 34 | 3.2 | GMO | 2.4 | 1.4 | 1.5 |

*trace

Table 2 shows the further increased challenge associated with the production of stable concentrates with the thermal dispersants and the detergent of Table 1, in the presence of even minor concentrations of organic friction modifiers such as glycerol mono-oleate (GMO) and TEEMA. Higher concentrations of organic friction modifier are generally required to obtain the desired low friction (high fuel economy) performance of modern engines. GMO in particular is shown to induce phase separation at levels well below concentrations needed to achieve the fuel economy performance target.

TABLE 3

| Ex | Disp Type | Det FV | Det Metal | Disp + Det AI (mass %) | Disp:Det Ratio | FM Type | FM (mass %) | PIBSA (mass %) | Conc Stab @ 12 wks (vol % sed) |
|---|---|---|---|---|---|---|---|---|---|
| 16 | Ene | 1.4 | Mg | 31 | 3.5 | GMO + TEEMA | 5.3* | 1.3 | tr* |
| 17 | Ene | 1.9 | Mg | 25 | 2.2 | TEEMA | 4.3 | 1.7 | tr* |
| 18 | Ene | 1.9 | Mg | 31 | 2.2 | TEEMA | 3.5 | 1.4 | 0.01 |
| 19 | Ene | 1,9 | Mg | 35 | 2.2 | TEEMA | 3.0 | 1.2 | tr* |
| 20 | Ene | 1.9 | Ca | 33 | 2.0 | TEEMA | 3.1 | 1.3 | 0.11 |
| 21 | Ene | 1.9 | Ca | 33 | 2.0 | TEEMA | 3.1 | 1.2 | 0.10 |
| 22 | Ene | 1.9 | Ca | 32 | 2.0 | TEEMA | 3.0 | 1.9 | 0.10 |

*trace

**50% GMO and 50% TEEMA

Table 3 compares the stability of concentrates comprising the elements of the present invention at organic friction modifier concentrations of 3.0 to 5.3 mass % using the friction modifiers GMO and TEEMA, with corresponding concentrates comprising an overbased magnesium detergent instead of the overbased calcium detergent. The magnesium detergent was an overbased alkyl benzene sulfonate detergent having a TBN of 700 mg KOH/g on an AI basis. The calcium detergent was the same as in Tables 1 and 2. In each of Table 2 and Table 3, a polyisobutylene succinic anhydride (PIBSA) having a $M_n$ of 1050 daltons was utilized as a compatibility aid.

It should be noted that the lubricant additive concentrates and lubricating oil compositions of this invention comprise defined, individual, i.e., separate, components that may or may not remain the same chemically before and after mixing. Thus, it will be understood that various components of the composition, essential as well as optional and customary, may react under the conditions of formulation, storage or use and that the invention also is directed to, and encompasses, the product obtainable, or obtained, as a result of any such reaction.

The disclosures of all patents, articles and other materials described herein are hereby incorporated, in their entirety, into this specification by reference. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A lubricant additive concentrate comprising:

(i) dispersant that is the polybutenyl succinimide reaction product of a polyamine and polybutenyl succinic anhydride (PIBSA) having a functionality of from about 1.3 to about 2.2, derived from polybutene having a number average molecular weight ($M_n$) of from about 1300 to about 2500 daltons and a terminal vinylidene content of at least about 50% and maleic anhydride via an ene maleation process;

(ii) overbased magnesium colloidal detergent having a total base number (TBN) of from about 300 to about 900 mg KOH/g; and (iii) organic friction modifier comprising organic friction modifier selected from at least one hydroxyalkyl alkyl amines of $C_{14}$ to $C_{24}$ hydrocarbons, at least one hydroxyalkyl alkyl ether amines of $C_{13}$ to $C_{24}$ hydrocarbons, at least one alkyl ester amine derived from triethanol amine having a $C_{13}$ to $C_{24}$ hydrocarbyl substituent, at least one non-basic, fatty acid amide, or a mixture thereof;

wherein:

a) the combined mass % of dispersant (i) and overbased magnesium colloidal detergent (ii) in said concentrate is from about 15 to about 50 mass %;

b) the mass ratio of (i):(ii) is from about 1:1 to about 6:1; and c) said concentrate contains from about 2 mass % to about 10 mass % of organic friction modifier (iii);

d) the remainder of the concentrate comprising base oil and additives other than dispersant (i), overbased magnesium colloidal detergent (ii) and organic friction modifier (iii); and e) said lubricant additive concentrate has a sediment content of no greater than 0.05 mass %, based on the total mass of the concentrate after 12 weeks of storage at 60° C.

2. A lubricant additive concentrate of claim 1, wherein dispersant (i) is derived from polybutene having a molecular weight distribution (MWD) of from about 1.2 to about 3.0.

3. A lubricant additive concentrate of claim 1, wherein said overbased magnesium colloidal detergent (ii) is derived from one or more surfactants selected from (a) sulfonate; (b) phenate; and (c) hydroxy benzoate surfactants.

4. A lubricant additive concentrate of claim 3, wherein said overbased magnesium colloidal detergent (ii) is derived from two or more different surfactants.

5. A lubricant additive concentrate of claim 1, comprising a mixture of magnesium and calcium detergents.

6. A lubricant additive concentrate of claim 1, comprising a mixture of organic friction modifier (iii) and organic friction modifier other than (iii).

7. A lubricant additive concentrate of claim 1, wherein the total concentration of organic friction modifier in the concentrate is from about 4 mass % to about 10 mass %.

8. A lubricant additive concentrate of claim 6, wherein the total concentration of organic friction modifier in the concentrate is from about 4 mass % to about 10 mass %.

9. A lubricant additive concentrate of claim 1, further comprising a low molecular weight hydrocarbyl or hydrocarbenyl substituted succinimide or succinic anhydride compatibility aid, derived from a hydrocarbyl or hydrocarbenyl group having a number average molecular weight ($M_n$) of from about 150 to about 1200 daltons.

10. A lubricant additive concentrate of claim 9, comprising from about 0.25 mass % to about 8 mass % of said compatibility aid.

11. A lubricant additive concentrate of claim 10, wherein said compatibility aid is octadecenyl succinic anhydride (ODSA), or polyisobutenyl succinic anhydride (PIBSA), or a mixture thereof.

12. The lubricant additive concentrate of claim 1, further comprising at least one additional additive selected from the group consisting of zinc-phosphorus antiwear agents, molybdenum-containing antiwear agents and/or friction modifiers, antioxidants, viscosity modifiers and pour point depressants.

13. The lubricant of claim 6, wherein the organic friction modifier other than (iii) is a glyceryl monoester of higher fatty acids; alkylated tartaric acid derivative; esters of long chain polycarboxylic acid with diols; or an oxazoline compound.

14. The lubricant additive concentrate of claim 9, where the compatibility aid to be added to the lubricant additive concentrate is not introduced into the concentrate without the detergent being present.

15. The lubricant additive concentrate of claim 1, where the dispersant is not borated.

16. The lubricant additive concentrate of claim 3, where the overbased magnesium colloidal detergent(s) comprises detergent(s) derived from one or more salicylate surfactants.

17. A lubricant additive concentrate comprising:

(i) dispersant that is the polybutenyl succinimide reaction product of a polyamine and polybutenyl succinic anhydride (PIBSA) having a functionality of from about 1.3 to about 2.2, derived from polybutene having a number average molecular weight ($M_n$) of from about 1300 to about 2500 daltons and a terminal vinylidene content of at least about 50% and maleic anhydride via an ene maleation process;

(ii) overbased magnesium colloidal detergent having a total base number (TBN) of from about 300 to about 900 mg KOH/g;

(iii) organic friction modifier comprising organic friction modifier selected from:

at least one hydroxyalkyl alkyl amines of $C_{14}$ to $C_{24}$ hydrocarbons, at least one hydroxyalkyl alkyl ether amines of $C_{13}$ to $C_{24}$ hydrocarbons, at least one alkyl ester amine derived from triethanol amine having a $C_{13}$ to $C_{24}$ hydrocarbyl substituent, at least one non-basic, fatty acid amide, or a mixture thereof; and (iv) glycerol mono-oleate;

wherein:

a) the combined mass % of dispersant (i) and overbased magnesium colloidal detergent (ii) in said concentrate is from about 15 to about 50 mass %;

b) the mass ratio of (i):(ii) is from about 1:1 to about 6:1;

c) said concentrate contains from about 2 mass % to about 10 mass % of organic friction modifier (iii);

d) the remainder of the concentrate comprises base oil and additives other than dispersant (i), overbased magnesium colloidal detergent (ii) and organic friction modifier (iii);

e) the total concentration of mixture of organic friction modifier (iii), glycerol mono-oleate, and organic friction modifier other than (iii) in the concentrate is from about 4 mass % to about 10 mass %; and f) said lubricant additive concentrate has a sediment content of no greater than 0.05 mass %, based on the total mass of the concentrate after 12 weeks of storage at 60° C.

18. A lubricant additive concentrate comprising:

(i) dispersant that is the polybutenyl succinimide reaction product of a polyamine and polybutenyl succinic anhydride (PIBSA) having a functionality of from about 1.3 to about 2.2, derived from polybutene having a number average molecular weight ($M_n$) of from about 1300 to about 2500 daltons and a terminal vinylidene content of at least about 50% and maleic anhydride via an ene maleation process;

(ii) overbased magnesium colloidal detergent having a total base number (TBN) of from about 300 to about 900 mg KOH/g;

(iii) organic friction modifier comprising organic friction modifier selected from:

at least one hydroxyalkyl alkyl amines of $C_{14}$ to $C_{24}$ hydrocarbons, at least one hydroxyalkyl alkyl ether amines of $C_{13}$ to $C_{24}$ hydrocarbons, at least one alkyl ester amine derived from triethanol amine having a $C_{13}$ to $C_{24}$ hydrocarbyl substituent, at least one non-basic, fatty acid amide, or a mixture thereof;

(iv) glycerol mono-oleate; and (v) natural diluent oil selected having a kinematic viscosity at 100° C. of about 2 to about 40 $mm^2/sec$;

wherein:

a) the combined mass % of dispersant (i) and overbased magnesium colloidal detergent (ii) in said concentrate is from about 15 to about 50 mass %;

b) the mass ratio of (i):(ii) is from about 1:1 to about 6:1;

c) said concentrate contains from about 2 mass % to about 10 mass % of organic friction modifier (iii);

d) the remainder of the concentrate comprises base oil and additives other than dispersant (i), overbased magnesium colloidal detergent (ii) and organic friction modifier (iii);

e) the total concentration of mixture of organic friction modifier (iii), glycerol molo-oleate, and organic friction modifier other than (iii) in the concentrate is from about 4 mass % to about 10 mass %; and f) said lubricant additive concentrate has a sediment content of no greater than 0.05 mass %, based on the total mass of the concentrate after 12 weeks of storage at 60° C.

19. The lubricant additive concentrate of claim 18, wherein the natural diluent oil is selected from animal oils, vegetable oils, liquid petroleum oils, and hydrorefined, solvent-treated, or acid-treated mineral oils of the paraffinic, naphthenic and mixed paraffinic-naphthenic types.

* * * * *